US006059705A

United States Patent [19]

Ruthenberg et al.

[11] Patent Number: 6,059,705

[45] Date of Patent: May 9, 2000

[54] METHOD AND APPARATUS FOR REGISTERING PROCESSING HEADS

[75] Inventors: Meyer L. Ruthenberg, Owings Mills; Douglas H. Silate, Glen Burnie; Barry E. Larkin, Timonium, all of Md.

[73] Assignee: United Container Machinery, Inc., Glen Arm, Md.

[21] Appl. No.: 08/953,160

[22] Filed: Oct. 17, 1997

[51] Int. Cl.[7] ..... B31B 1/00; B31B 49/00

[52] U.S. Cl. ..... 493/11; 493/8; 493/10; 493/34; 493/3

[58] Field of Search ..... 493/3, 8, 10, 34, 493/67, 11, 21, 22, 36, 71, 72; 53/52, 55, 58, 498, 51

[56] References Cited

U.S. PATENT DOCUMENTS

| | | | |
|---|---|---|---|
| 3,510,036 | 5/1970 | Lewis, Jr. et al. | 226/2 |
| 3,744,649 | 7/1973 | Ward, Jr. | 214/6 |
| 3,745,864 | 7/1973 | Watson | 83/295 |
| 3,806,012 | 4/1974 | Roch | 226/2 |
| 3,899,686 | 8/1975 | Luska | 250/555 |
| 4,095,511 | 6/1978 | Woolston | 93/58.2 |
| 4,159,109 | 6/1979 | Watson et al. | 271/259 |
| 4,181,298 | 1/1980 | Capdeboscq | 271/5 |
| 4,240,312 | 12/1980 | Ward, Sr. | 83/311 |
| 4,280,386 | 7/1981 | Ward, Sr. | 83/500 |
| 4,295,841 | 10/1981 | Ward, Jr. | 493/295 |
| 4,295,842 | 10/1981 | Bell | 493/342 |
| 4,438,696 | 3/1984 | George et al. | 101/180 |
| 4,449,450 | 5/1984 | Barny et al. | 101/232 |
| 4,458,893 | 7/1984 | Ruh | 271/277 |
| 4,471,693 | 9/1984 | Tsukasaki | 101/183 |
| 4,474,565 | 10/1984 | Watson et al. | 493/342 |
| 4,494,745 | 1/1985 | Ward, Sr. et al. | 271/95 |
| 4,500,243 | 2/1985 | Ward, Jr. et al. | 414/50 |
| 4,500,244 | 2/1985 | Sardella et al. | 414/92 |
| 4,515,079 | 5/1985 | Dahlgren | 101/183 |
| 4,527,788 | 7/1985 | Masuda | 270/21.1 |
| 4,567,824 | 2/1986 | Dahlgren et al. | 101/183 |
| 4,596,541 | 6/1986 | Ward, Sr. et al. | 493/59 |
| 4,604,083 | 8/1986 | Barny et al. | 493/34 |
| 4,617,850 | 10/1986 | Bishop | 83/324 |
| 4,618,391 | 10/1986 | Torti et al. | 156/353 |
| 4,632,378 | 12/1986 | Sardella | 271/202 |
| 4,632,381 | 12/1986 | Cuir et al. | 271/270 |
| 4,643,413 | 2/1987 | Ward, Sr. et al. | 271/95 |
| 4,656,815 | 4/1987 | Jaton | 53/58 |
| 4,657,236 | 4/1987 | Hirakawa et al. | 271/99 |
| 4,683,822 | 8/1987 | Sardella et al. | 101/382 |
| 4,725,261 | 2/1988 | Millard et al. | 493/82 |
| 4,736,660 | 4/1988 | Benach et al. | 83/174 |
| 4,744,297 | 5/1988 | Sardella et al. | 101/382 |
| 4,774,446 | 9/1988 | Salazar et al. | 318/561 |
| 4,781,317 | 11/1988 | Ditto | 226/27 |

(List continued on next page.)

FOREIGN PATENT DOCUMENTS

| | | | |
|---|---|---|---|
| 1190305 | 9/1985 | Canada | 341/41 |
| 0521158 | 1/1993 | European Pat. Off. | 5/22 |
| 0615941 | 9/1994 | European Pat. Off. . | |
| 2083449 | 3/1982 | United Kingdom | 471/535 |

*Primary Examiner*—James F. Coan
*Assistant Examiner*—Gene L. Kim
*Attorney, Agent, or Firm*—Biebel & French

[57] ABSTRACT

A paperboard blank processing apparatus including a rotatably mounted processing head for operating upon successive paperboard blanks is disclosed. A paperboard blank registration sensor is provided upstream from the processing head for detecting a preprinted registration mark on a surface of an approaching paperboard blank. A controller is responsive to the registration sensor for determining whether the approaching paperboard blank is in proper registration with the rotary processing head. A registration correction window is defined by the controller and includes upper and lower limits defining upper and lower maximum correction values for bringing the angular position of the processing head into proper register with the linear position of the approaching paperboard blank. The controller further defines an averaging window containing the registration correction window wherein the registration correction window may be shifted within the averaging window in response to consistent registration errors.

30 Claims, 11 Drawing Sheets

U.S. PATENT DOCUMENTS

| | | | |
|---|---|---|---|
| 4,847,775 | 7/1989 | Roch et al. | 364/469 |
| 4,867,433 | 9/1989 | Wells et al. | 271/35 |
| 4,878,407 | 11/1989 | Harrison et al. | 83/13 |
| 4,958,829 | 9/1990 | Ward, Jr. | 271/273 |
| 4,976,672 | 12/1990 | Harrison et al. | 493/130 |
| 5,000,725 | 3/1991 | Bauknecht | 493/11 |
| 5,006,042 | 4/1991 | Park | 414/795.4 |
| 5,018,718 | 5/1991 | Matsuno et al. | 271/245 |
| 5,024,081 | 6/1991 | Razauskas et al. | 73/104 |
| 5,050,994 | 9/1991 | Kipphan et al. | 356/445 |
| 5,074,539 | 12/1991 | Wells et al. | 271/12 |
| 5,078,666 | 1/1992 | Porret et al. | 493/1 |
| 5,094,442 | 3/1992 | Kamprath et al. | 271/227 |
| 5,103,733 | 4/1992 | Drapatsky et al. | 101/485 |
| 5,123,887 | 6/1992 | Shimura | 493/34 |
| 5,138,667 | 8/1992 | Roch et al. | 382/1 |
| 5,177,930 | 1/1993 | Harston et al. | 53/55 |
| 5,181,899 | 1/1993 | Hill et al. | 493/34 |
| 5,213,036 | 5/1993 | Tokuno et al. | 101/232 |
| 5,241,483 | 8/1993 | Porret et al. | 364/469 |
| 5,242,364 | 9/1993 | Lehmann | 493/34 |
| 5,292,299 | 3/1994 | Anderson et al. | 493/11 |
| 5,329,466 | 7/1994 | Monney | 364/559 |
| 5,372,569 | 12/1994 | Ballos, III | 493/34 |
| 5,383,392 | 1/1995 | Kowalewski et al. | 101/183 |
| 5,385,091 | 1/1995 | Cuir et al. | 101/217 |
| 5,451,042 | 9/1995 | Cuir et al. | 271/112 |
| 5,452,632 | 9/1995 | Dürr et al. | 83/13 |
| 5,463,950 | 11/1995 | Cuir et al. | 101/329 |
| 5,518,559 | 5/1996 | Saindon et al. | 156/64 |
| 5,531,432 | 7/1996 | Sardella | 271/10.01 |
| 5,542,353 | 8/1996 | Cuir et al. | 101/492 |
| 5,596,861 | 1/1997 | Preston et al. | 493/34 |
| 5,606,913 | 3/1997 | Kowalewski | 101/183 |
| 5,638,268 | 6/1997 | Souza | 493/34 |

METHOD AND APPARATUS FOR REGISTERING PROCESSING HEADS

BACKGROUND OF THE INVENTION

1. Field of the Invention

The present invention relates to the processing of paperboard blanks and, more particularly, to a method and apparatus for maintaining the proper registration between a rotary processing head and successive paperboard blanks.

2. Description of the Prior Art

During the manufacture of paperboard boxes, paperboard blanks are successively passed through a processing machine including a plurality of sections having cooperating rotary processing heads for performing operations on the paperboard blank. Such operations typically include, among others, printing graphics, forming crease lines and cutting each successive paperboard blank to thereby form a container blank which may be readily folded into a paperboard box.

More particularly, as the rotary processing heads of each section rotate in contact with successive paperboard blanks, each head performs an operation in a predetermined position on the blank. Therefore, each successive operation is superimposed on top of the preceding operation thereby forming the completed printed container blank. If the rotary processing heads of any section are not in proper registration or phase with the approaching paperboard blank to be operated upon, then the operation performed by the processing heads will not be correctly positioned on the paperboard blank. As such, the resulting superimposed operations are not properly aligned on the paperboard blank and the completed container blank is often rejected as an inferior product.

Prior art attempts to produce acceptable container blanks have included the strategy of using oversized blanks within the processing machine to account for registration errors between the processing heads and the paperboard blank. Operations which are misaligned on the paperboard blank due to registration errors are at least partially corrected by trimming excess material from either the leading edge or trailing edge of the oversized paperboard blank. While the resulting container blank is often acceptable for use in forming a paperboard box, this method of correcting for registration errors is expensive in terms of both time and wasted paperboard.

Additionally, the need to maintain accurate registration between rotary processing heads and paperboard blanks in the production of color printed container blanks has become more critical with higher production speeds and the demand for higher quality printing and multi-color graphics. In response, attempts have been made to provide paperboard processing devices which maintain the proper registration of each paperboard blank passing in contact with rotary processing heads.

Examples of typical registration devices may be seen in U.S. Pat. Nos. 4,618,391 and 5,383,392. However, such prior art devices have failed to provide reliable and consistent registration correction. The prior art devices fail to distinguish between registration errors which are correctable and those which are not correctable given the operating conditions and geometry of the processing machine. Additionally, the prior art devices fail to account for continuing and consistent registration errors as often caused by components within the processing machine. For example, operating members may impart drag forces on the paperboard blank or the paperboard blank may consistently slip relative to a forwardly conveying member.

Accordingly, there is a need for a method and apparatus for working paperboard blanks which maintains the accurate registration of a rotary processing head with successive paperboard blanks. Further, there is a need for such a method and apparatus which corrects the registration of the processing head relative to successive paperboard blanks while adjusting for recurring errors in registration between the processing head and the paperboard blank.

SUMMARY OF THE INVENTION

The present invention provides a paperboard blank processing method and apparatus for maintaining the proper registration between a rotary processing head and successive paperboard blanks. Further, the present invention provides a method and apparatus for detecting consistent registration errors between a rotary processing head and successive paperboard blanks and for making selective correcting adjustments in response thereto.

The paperboard blank processing apparatus of the present invention comprises a rotatably mounted processing head for operating upon a downstream paperboard blank. A drive is operably connected to the processing head for driving the processing head in rotation at a predetermined line speed. Means are provided for monitoring an angular position of the processing head and for providing a processing head position signal indicative of the angular position of the processing head. The drive and means for monitoring the angular position of the processing head comprise an integral alternating current servo motor.

A paperboard blank registration sensor detects a linear position of an upstream paperboard blank located upstream from the processing head and provides a blank position signal indicative of the linear position of the upstream paperboard blank. The distance between the paperboard blank registration sensor and the processing head is preferably at least as great as a distance between a trailing edge of the downstream paperboard blank and a leading edge of the upstream paperboard blank wherein the processing head is operating upon the downstream paperboard blank while the sensor is simultaneously scanning the upstream paperboard blank. The paperboard blank registration sensor is preferably an optical contrast scanner adapted for detecting a preprinted mark positioned on a surface of the upstream paperboard blank. Alternatively, the registration sensor may be adapted for detecting a leading edge of the upstream paperboard blank.

A controller is responsive to the processing head position signal and the blank position signal for generating a registration error signal indicative of registration error between the angular position of the processing head and the linear position of the upstream paperboard blank. A registration correction window is defined by the controller and includes upper and lower limits defining upper and lower maximum correction values for bringing the angular position of the processing head into register with the linear position of the upstream paperboard blank. A theoretical registration position is located intermediate the upper and lower limits of the registration correction window and defines where the angular position of the processing head and the linear position of the paperboard blank are in proper registration. The controller further comprises means for determining whether the registration error signal has a value within the registration correction window and means for selectively altering the angular position of the processing head relative to the linear position of the upstream paperboard blank in response to the registration error signal.

In the preferred embodiment, the angular position of the processing head is altered relative to the linear position of the paperboard blank by the upper maximum correction value if the registration error signal exceeds the upper limit of the registration correction window. Likewise, the angular position of the processing head is altered relative to the linear position of the paperboard blank by the lower maximum correction value if the registration error signal exceeds the lower limit of the registration correction window. Alternatively, the controller may be programmed to alter the angular position of the processing head relative to the linear position of the upstream paperboard blank only if the registration error signal has a value within the registration correction window.

The paperboard blank processing apparatus of the present invention further comprises an averaging window containing the registration correction window and defined by the controller. The controller includes means for averaging a plurality of processing head position signals associated with a plurality of successive paperboard blanks to produce an average position signal and for shifting the registration correction window within the averaging window in response to the average position signal.

An alternative embodiment of the present invention provides for a method of maintaining the registration of a processing head with successive paperboard blanks, the method comprising the steps of driving a processing head in rotation at a predetermined line speed, transporting a paperboard blank towards the processing head, detecting the paperboard blank at a location upstream from the processing head and providing a blank position signal indicative of the position of the paperboard blank, and monitoring an angular position of the processing head and providing a processing head position signal indicative of the angular position of the processing head. The method further comprises the steps of providing a registration correction window including upper and lower limits defining upper and lower maximum correction values for bringing the angular position of the processing head into proper registration with the linear position of the paperboard blank, providing a theoretical registration position located intermediate of the upper and lower limits and defining where the angular position of the processing head and the linear position of the paperboard blank are in proper registration, generating a registration error signal by comparing the processing head position signal to the theoretical registration position, and selectively altering the angular position of the processing head relative to the linear position of the paperboard blank in response to the registration error signal. The step of altering the angular position of the processing head preferably comprises selectively varying the line speed of the processing head to bring the angular position of the processing head into proper register with the linear position of the paperboard blank.

Preferably, the angular position of the processing head is altered relative to the linear position of the paperboard blank by the upper maximum correction value if the registration error signal exceeds the upper limit of the registration correction window and the angular position of the processing head is altered relative to the linear position of the paperboard blank by the lower maximum correction value if the registration error signal exceeds the lower limit of the registration correction window. The method of the present invention may further comprise the steps of providing an averaging window, averaging a plurality of processing head position signals associated with a plurality of successive paperboard blanks to produce an average position signal, and shifting the registration correction window within the averaging window in response to the average position signal.

Therefore, it is an object of the present invention to provide a paperboard blank processing method and apparatus for sensing and accurately correcting a registration error between a rotary processing head and a paperboard blank.

It is another object of the invention to provide such a paperboard blank processing method and apparatus for correcting a registration error between a rotary processing head and an upstream paperboard blank while a downstream paperboard blank is simultaneously operated upon by the processing head.

It is a further object of the invention to provide a method and apparatus for correcting registration errors between a rotary processing head and each of a plurality of successive paperboard blanks.

It is an additional object of the invention to provide a method and apparatus for sensing either a leading edge of a paperboard blank or a preprinted mark on a surface of the paperboard blank and for determining registration errors therefrom.

It is yet another object of the invention to provide a method and apparatus for correcting registration errors between a rotary processing head and a maximum number of successive paperboard blanks.

It is an additional object of the present invention to provide a method and apparatus which selectively corrects registration errors within a predetermined registration correction window.

It is still yet another object of the invention to provide a method and apparatus which adjusts such registration correction window in response to the average of a plurality of processing head positions associated with a plurality of successive paperboard blanks.

Other objects and advantages of the invention will be apparent from the following description, the accompanying drawings and the appended claims.

DETAILED DESCRIPTION OF THE PREFERRED EMBODIMENT

Figure 1:
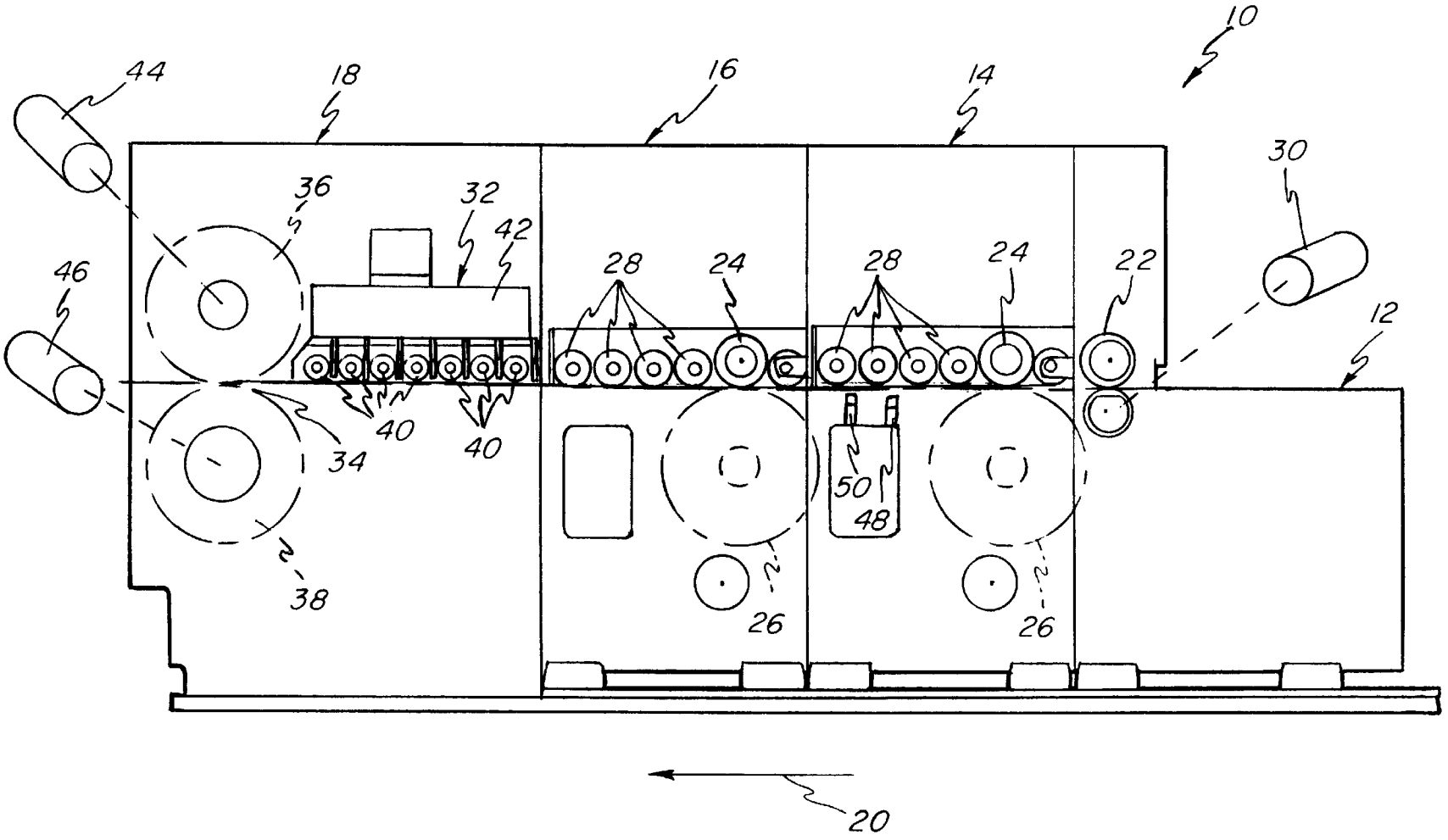
FIG. 1 is a side view in partial schematic of a paperboard blank processing apparatus according to the present invention.

The preferred embodiment of the present invention is incorporated within a flexographic die-cut machine 10 as illustrated in FIG. 1. The flexographic die-cut machine 10 includes a feed section 12, a first print section 14, a second print section 16 and a die-cut section 18 positioned successively downstream from each other. Paperboard blanks are conveyed through the machine 10 in the direction of arrow 20 successively between the feed section 12, the first and second print sections 14 and 16, and the die-cut section 18.

The feed section 12 includes a pair of cooperating pull rolls 22 for pulling each paperboard blank fed to the machine 10 towards the first print section 14. Each print section 14 and 16 includes an impression roll 24 which cooperates with a print cylinder 26 for printing graphics on the lower surface of a paperboard blank as it passes between the impression roll 24 and print cylinder 26. Transfer wheels 28, of the type well known in the art, convey the paperboard blank from the first print section 14 to the second print section 16 and thereafter to the die-cut section 18. Both print sections 14 and 16 and the feed section 12 are preferably driven by a single individually controlled alternating current servo motor 30.

The die-cut section 18 includes a vacuum conveyor 32 which feeds each successive paperboard blank to a nip 34 defined by a die drum 36 and an anvil drum 38 for cutting the paperboard blank. The vacuum conveyor 32 includes a plurality of transfer wheels 40 driven in rotation and a plenum 42 for drawing a vacuum against the upper surface of the paperboard blank. The paperboard blank is thereby held in frictional engagement with the wheels 40 for facilitating its transport through the die-cut section 18. The die drum 36 and transfer wheels 40 are driven in unison by a servo motor 44 while the anvil drum 38 is independently driven in rotation by a servo motor 46. The servo motors 30, 44 and 46 are all preferably of alternating current design to facilitate rapid response and may comprise Model No. ZAD 160B available from Rexroth Indramat of Hoffinan Estates, Ill.

A paperboard blank counter sensor 48 is positioned intermediate the print cylinders 26 of the first and second print sections 14 and 16. The counter sensor 48 is preferably a photo sensitive cell for sensing light levels, and may comprise mini-beam sensor, Part No. SM312LV available from Banner Engineering Corp. A paperboard blank registration sensor 50 is likewise positioned between the print cylinders 26 of the first and second print sections 14 and 16 and preferably comprises an optical contrast scanner of the type well known in the art. More particularly, registration sensor 50 may comprise Model KTS-P1212 available from Sick Optic Electronic of Eden Prairie, Minn.

While both sensors 48 and 50 may be positioned either above or below the board line facing a surface of the paperboard blank, it is preferred that the registration sensor 50 be located below the board line and facing the printed surface of the paperboard blank. In this manner, the registration sensor 50 may be activated by sensing either the leading edge of the paperboard blank or a preprinted mark on the lower surface of the paperboard blank. Of course, if the print cylinders 26 were positioned above the board line such that printing occurred on the upper surface of the blank, then the registration sensor 50 would be preferably located above the board line and facing the printed surface.

While the preceding discussion has described a flexographic die-cut machine 10 including a die-cut section 18 downstream from a pair of print sections 14 and 16, it will be readily appreciated that the present invention may be used with variations of this machine 10. For example, the machine 10 may have different or additional sections such as further printing sections, creasing and slotting sections, gluing and folding sections, etc. The present invention may be used to bring any rotary processing head into proper registration with an approaching paperboard blank.

Figure 2:
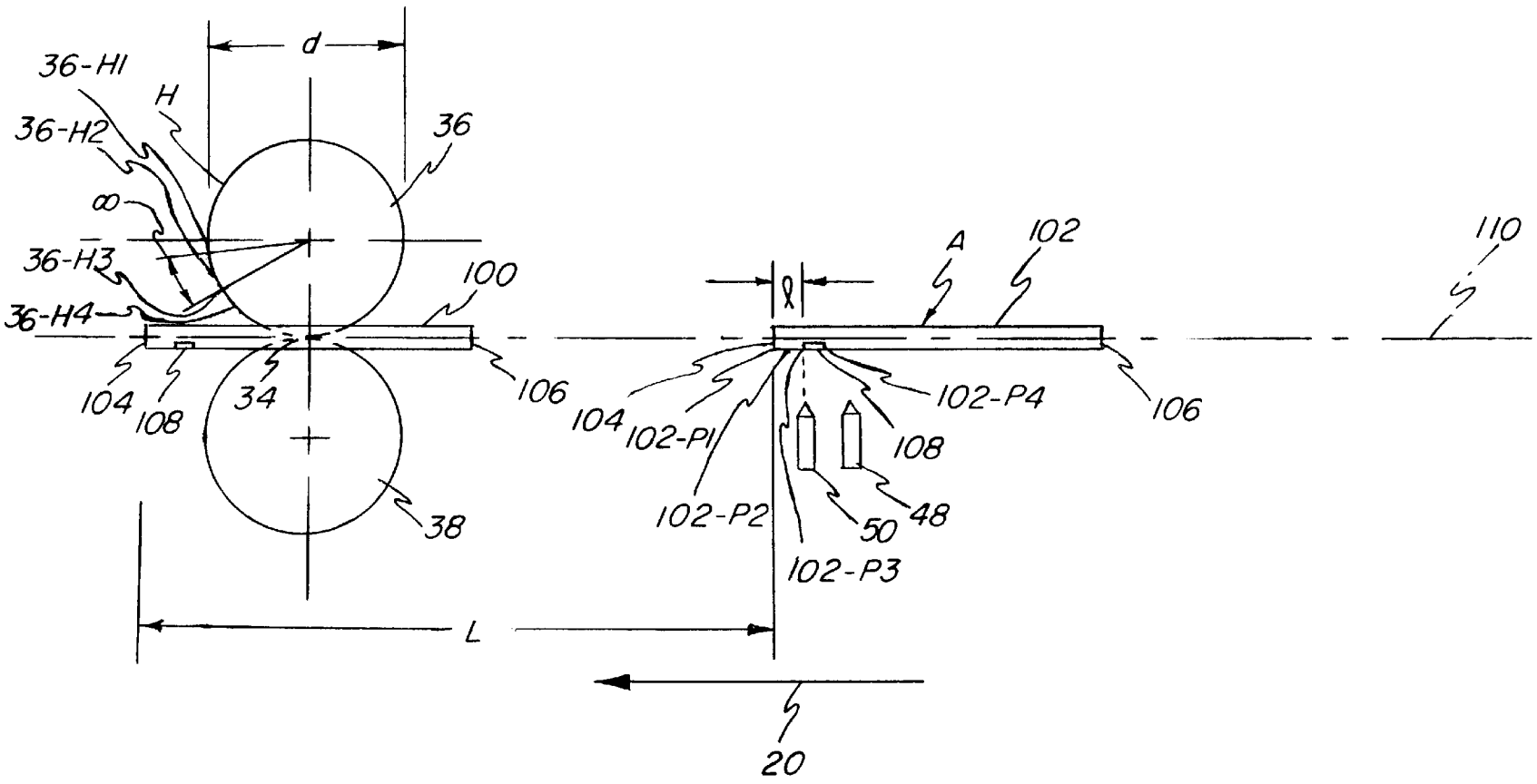
FIG. 2 is a partial schematic side view of successive paperboard blanks passing through the paperboard blank processing apparatus according to the invention.
Figure 3:
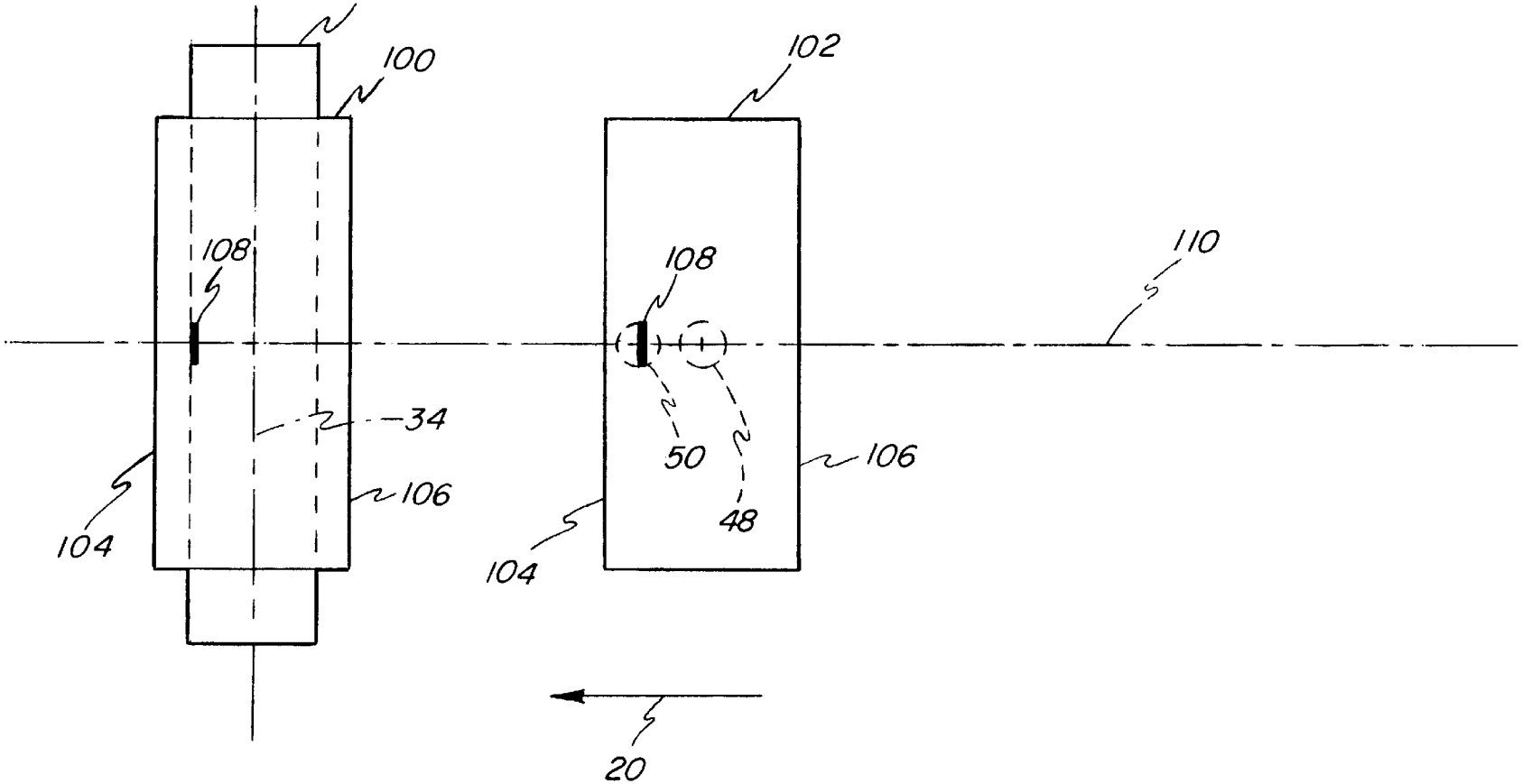
FIG. 3 is a partial schematic bottom view of successive paperboard blanks passing through the paperboard blank processing apparatus according to the invention.

FIGS. 2 and 3 diagrammatically illustrate downstream and upstream paperboard blanks 100 and 102, respectively, being transported through the flexographic die-cut machine 10, wherein details of the feed section 12 and print sections 14 and 16 have been removed for clarity. Each paperboard blank 100 and 102 includes a leading edge 104 and a trailing edge 106. A pre-printed registration mark 108 is located intermediate the leading edge 104 and trailing edge 106 on a lower surface of each paperboard blank 100 and 102. Preferably, the mark 108 is pre-printed on the blanks 100 and 102 before they enter the first print section 14 of the machine 10. Alternatively, registration mark 108 may be applied to the lower surface of the paperboard blanks 100 and 102 by the first print section 14 prior to the paperboard blanks 100 and 102 approaching the registration sensor 50 (FIG. 1).

While the preprinted mark 108 may be positioned anywhere on the paperboard blanks 100 and 102, it is preferably located near the center axis 110 of the machine 10 and proximate the leading edge 104. This location optimizes the registration capability of the machine 10 by providing the maximum time to move the die drum 36, or other processing head, to its new registration position before the upstream paperboard blank 102 enters the die-cut section 18.

The mark 108 is typically a black rectangle on a white background and may be part of the normal graphics printed on each paperboard blank 100 and 102 or specifically printed for registration correction purposes. The registration sensor 50 responds to a light to dark transition such that the mark 108 may comprise any one of numerous variations of the blank rectangle on a white background configuration.

With further reference to FIG. 2, it may be readily appreciated that each linear position along the length of the each successive paperboard blank 100 and 102 corresponds to a point on the operating circumference H of the processing head, here the die drum 36. More particularly, the distance between leading edges 104 of successive paperboard blanks 100 and 102, identified by the reference letter L, equals the operating circumference of the processing head 36, identified by the reference letter H and as defined by the equation $H=\pi d$, where d equals the operating diameter of the processing head 36. It should be noted that the operating circumference H and operating diameter d of the processing head 36 are defined by the tool or operating member which contacts successive paperboard blanks 100 and 102.

The angular position of the processing head 36, identified in FIG. 2 by reference letter , is related to the linear position of each paperboard blank 100 and 102, as identified by reference letter l, by the equation, $l=\pi d( /360)$ where, once again, d is the operating diameter of the processing head 36. As seen in FIG. 2, selected locations on the operating circumference H of the processing head 36 are identified by the reference numeral 36 in combination with the suffix H1, H2, H3 or H4. Likewise, selected locations located along the paperboard blank 102 are identified by the reference numeral 102 in combination with the suffix P1, P2, P3 or P4.

Figure 4:
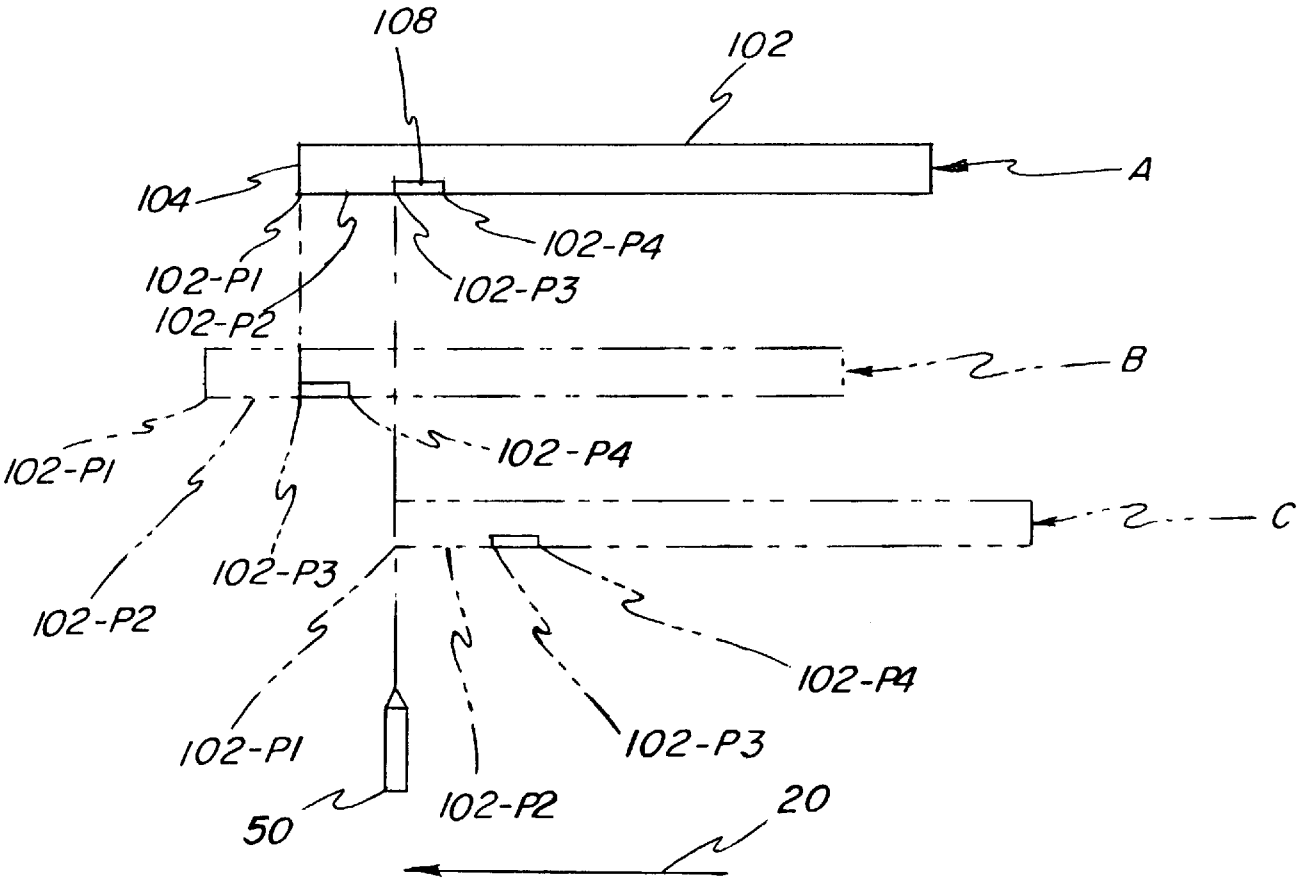
FIG. 4 is a diagrammatic side view of paperboard blanks in different registration positions.

If the processing head 36 is in proper registration with the upstream paperboard blank 102, as identified by reference letter A in FIGS. 2 and 4, then locations 36-H1 through 36-H4 on the processing head 36 are in position to engage the upstream blank 102 at locations 102-P1 through 102-P4, respectively. However, if the upstream paperboard blank occupies position B as shown in FIG. 4, then it is advancing ahead of the theoretical proper registration position A. As such, positions 36-H1 and 36-H2 of the processing head 36 correspond to positions 102-P3 and 102-P4 of the paperboard blank 102, respectively. Similarly, if the upstream paperboard blank 102 occupies position C as indicated in FIG. 4, then it is lagging behind the theoretical or proper registration position A. Processing head positions 36-H3 and 36-H4 therefor correspond to paperboard blank positions 102-P1 and 102-P2, respectively.

Figure 5:
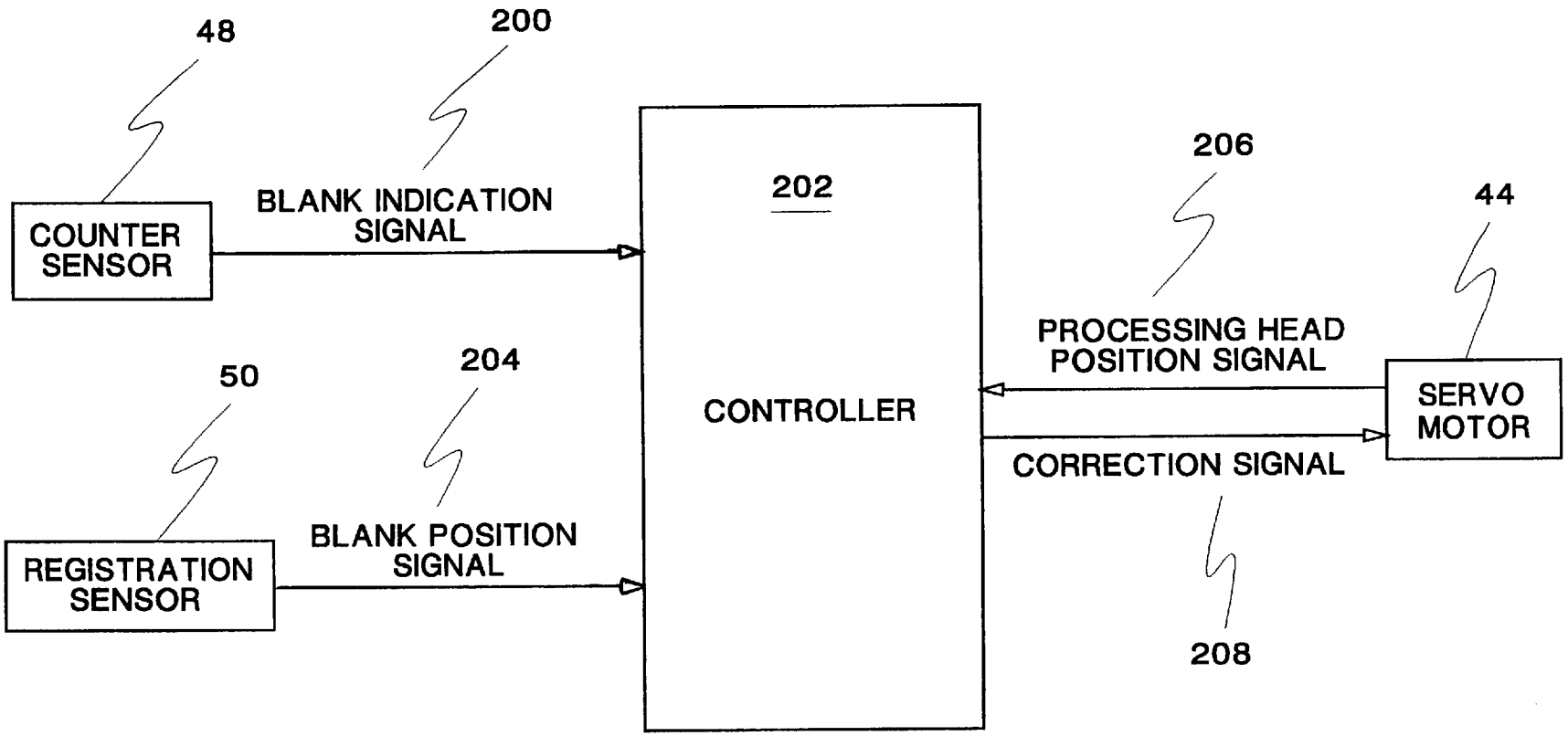
FIG. 5 is a block diagram illustrating the computer control system of the paperboard blank processing apparatus of the present invention.

Turning now to FIG. 5, with further reference to FIGS. 2 and 3, the leading edge 104 of the upstream paperboard blank 102 is detected by the paperboard blank counter sensor 48 which then sends a blank indication signal 200 to a controller 202. The controller 202 accumulates successive blank indication signals 200 to keep track of the number of paperboard blanks 102 processed through the machine 10. Meanwhile, the paperboard blank registration sensor 50 is continually scanning and upon detecting the preprinted mark 108 on the paperboard blank 102, it sends a blank position signal 204 to the controller 202.

Upon receiving the blank position signal 204, the controller 202 requests a processing head position signal 206 from the servo motor 44. The processing head position signal 206 provides an indication of the angular position of the die drum 36. As described in greater detail below, the controller 202 next determines whether the die drum 36 is in proper registration with the upstream paperboard blank 102. If the upstream paperboard blank 102 is advancing ahead of a theoretical or proper registration position, as identified by reference letter B in FIG. 4, the controller 202 will send a registration correction signal 208 to the servo motor 44 instructing the servo motor 44 to accelerate the die drum 36 from its line speed. The controller 202 then decelerates the servo motor 44 back to the line speed such that the angular position of the die drum 36 is brought into proper registration with the upstream paperboard blank 102. Likewise, if the paperboard blank 102 is detected in position C as indicated in FIG. 4, and thereby lagging behind the theoretical or proper registration position A, the controller 202 sends a registration correction signal 208 to the servo motor 44 for decelerating the die drum 36 from its line speed. The controller 202 next accelerates the servo motor 44 back to its line speed such that the angular position of the die drum 36 is brought into proper registration with the linear position of the paperboard blank 102.

It should be noted that the distance between the trailing edge 106 of the downstream paperboard blank 100 and the leading edge 104 of the upstream paperboard blank 102 is less than the distance between the nip 34 of the rotary processing heads 36 and 38 and the paperboard blank registration sensor 50. As such, the paperboard blank registration sensor 50 is scanning the upstream paperboard blank 102 simultaneously as the downstream paperboard blank 100 is being operated upon by the processing heads 36 and 38. Further, it will be appreciated that the leading edge 104 of the downstream paperboard blank 100 should be within the control of the die cut section 18 before the controller 202 varies the line speed of the die drum 36. If this were not the case, then accelerating or decelerating the die drum 36 from its line speed to bring it into proper registration with the upstream paperboard blank 102 would alter the angular position of the die drum 36 relative to the linear position of the downstream paperboard blank 100. In effect, correcting the registration for each upstream paperboard blank 102 would result in the downstream paperboard blank 100 being taken out of proper registration with the die drum 36.

In the preferred embodiment, the controller 202 is programed to ensure that the downstream paperboard blank 100 engages at least two transfer wheels 40 prior to accelerating or decelerating the die drum 36 (FIG. 1). Since the transfer wheels 40 and the die drum 36 are controlled by the same servo motor 44, the angular position of the die drum 36 is fixed relative to the linear position of the downstream paperboard blank 100 once the paperboard blank 100 is within control of the vacuum transfer wheels 40.

Figure 6:
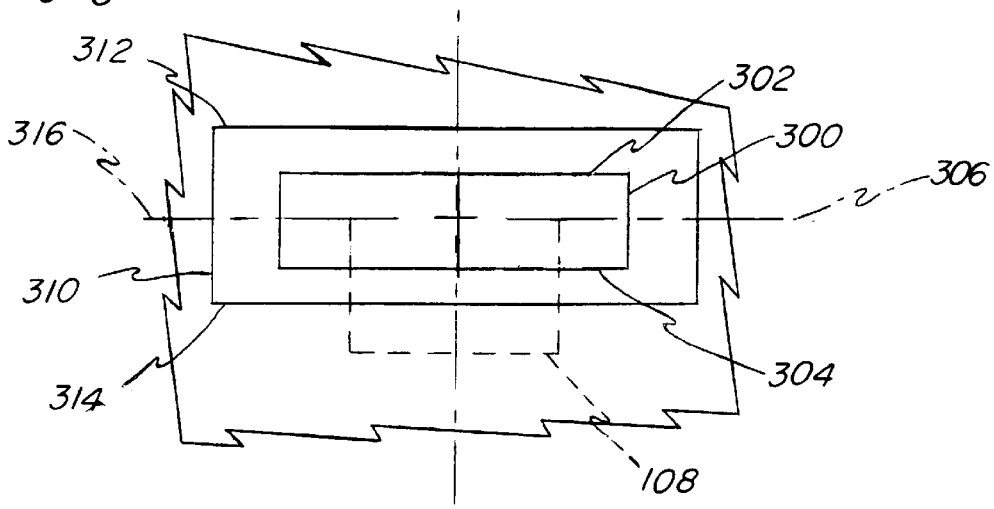
FIG. 6 is schematic illustration of the registration correction and averaging windows of the invention.
Figure 7:
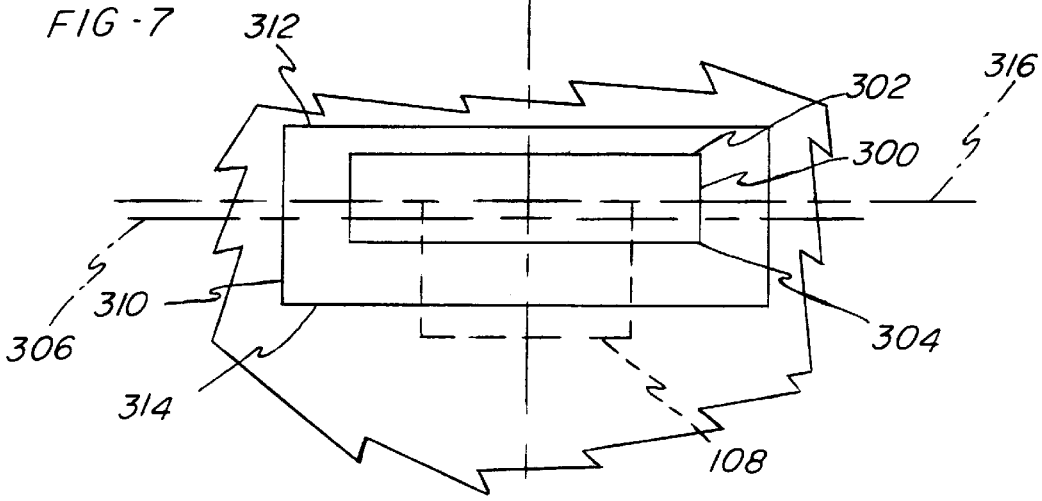
FIG. 7 is a schematic illustration showing the registration correction window shifted in a first direction within the averaging window.
Figure 8:
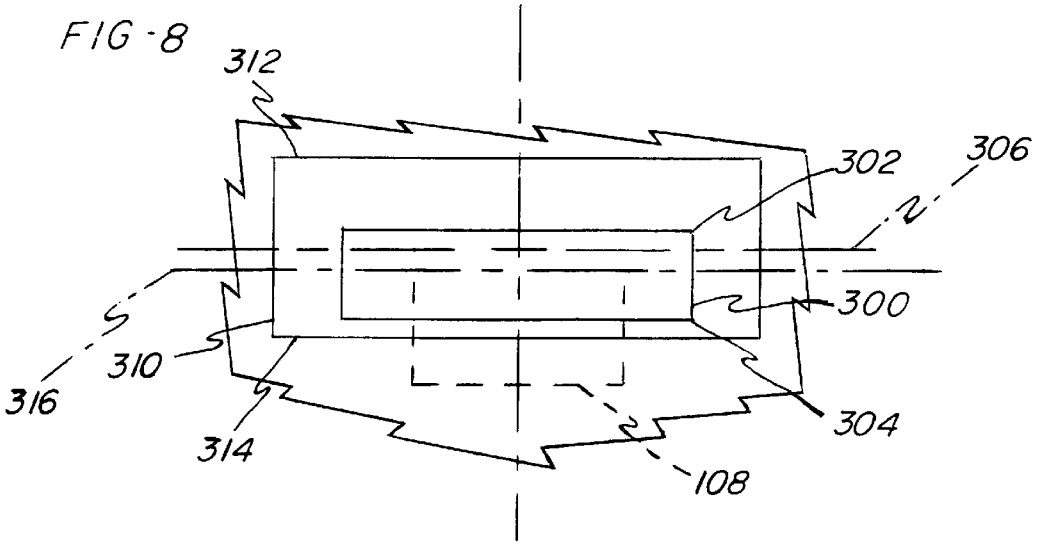
FIG. 8 is a schematic illustration of the registration correction window shifted in a second direction within the averaging window.
Figure 9:
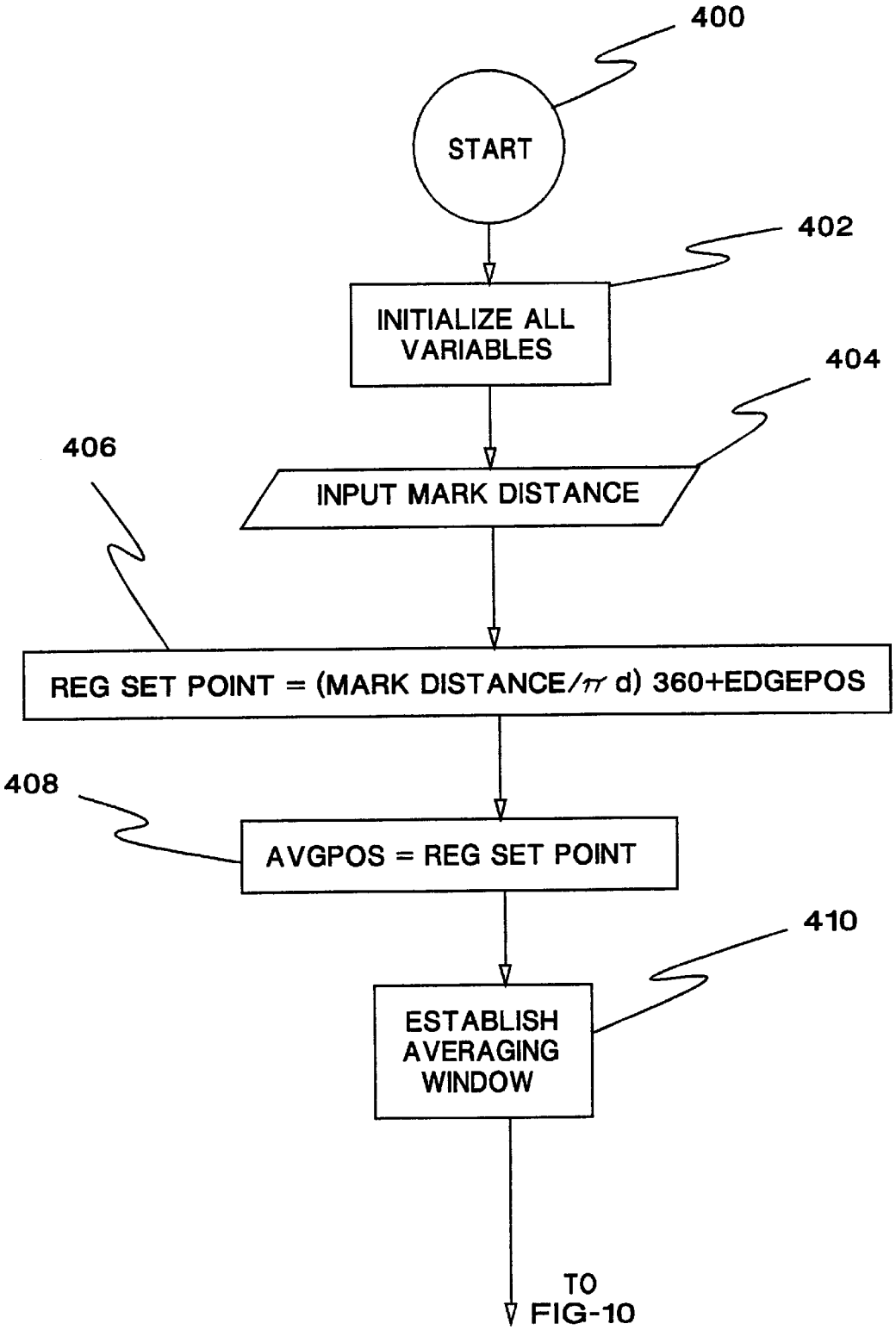
FIGS. 9–13 are flow charts illustrating the operation of the controller employed in the present invention.

Every paperboard blank processing machine 10 has certain registration correction limitations based upon a variety of factors, including but not limited to processing speed, distance between adjacent paperboard blanks, processing head inertia, and the power of the processing head drive components. If a paperboard blank advances ahead of a maximum correction value or lags behind a lower maximum correction value, then complete registration correction between the processing head and the paperboard blank is not possible. Referring now to FIGS. 6–8, the controller 202 of the present invention defines a registration correction window 300 having upper and lower limits 302 and 304, respectively. The upper limit 302 corresponds to the maximum correction value for an upstream paperboard blank 102 advancing ahead of the theoretical or proper registration position. Likewise, the lower limit 304 corresponds to the maximum correction value for an upstream paperboard blank 102 lagging behind the theoretical or proper registration position. The upper and lower limits 302 and 304 are centered about an initial theoretical or proper registration position 306 initially defining where the die drum 36 is in proper registration with the upstream paperboard blank 102.

As an illustrative example, assuming that the value of the theoretical registration position 306 equals zero, the value of the upper limit 302 is preferably equal to +⅛ inch, while the value of the lower limit 304 is preferably equal to −⅛ inch, thereby providing a registration correction window 300 having a total correction value of ¼ inch. The controller 202 compares the processing head position signal 206 to the theoretical registration position 306 to generate a registration error signal indicative of the registration error between the die drum 36 and upstream paperboard blank 102. The controller 202 then determines whether the resulting registration error signal falls within the upper and lower limits 302 and 304 of the registration correction window 300.

In the preferred embodiment, if the registration error signal falls within the registration correction window 300 then the controller 202 sends a correction signal 208 to the servo motor 44 to vary the line speed of the die drum 36. If the registration error signal has a positive value then the die drum 36 is initially accelerated and then decelerated back to line speed. If the registration error signal has a negative value then the die drum 36 is initially decelerated and then accelerated back to line speed. The variation in line speed alters the angular position of the die drum 36 relative to the linear position of the paperboard blank 102 by the value of the registration error signal.

If the registration error signal exceeds the upper limit 302 of the registration correction window 300, i.e. is greater than +⅛ inch, then the controller 202 sends a correction signal 208 to the servo motor 44 to correct the angular position of the die drum 36 relative to the linear position of the paperboard blank 102 by the upper limit 302 of the registration correction window 300. If the registration error signal exceeds the lower limit 304 of the registration correction window 300, i.e. is less than −⅛ inch, then the controller 202 sends a correction signal 208 to the servo motor 44 to correct the angular position of the die drum 36 relative to the linear position of the paperboard blank 102 by the lower limit 304. In other words, if the registration error signal is negative and has an absolute value greater than the absolute value of the lower limit 304, then the angular position of the die drum 36 is adjusted by the lower limit 304. Alternatively, the controller 202 may be programmed to perform no registration correction if the value of the registration error signal exceeds either the upper limit 302 or the lower limit 304 of the registration correction window 300.

As described above, operating conditions or machine components may cause recurring registration errors among successive paperboard blanks 102. For example, operating members may impose dragging forces on each paperboard blank, or each paperboard blank may slip relative to a conveying element. Both instances will cause each successive paperboard blank to consistently lag behind a proper registration position, as illustrated by reference letter C in FIG. 4. The controller 202 in such a situation would have to continually make adjustments for this recurring error with respect to each successive paperboard blank 102.

The present invention accounts for such recurring errors by the controller 202 defining an averaging window 310 about the registration correction window 300. The averaging window 310 includes upper and lower limits 312 and 314, respectively, defined by operating conditions and the geometry of the processing machine 10. In the preferred embodiment, if the theoretical registration position 306 equals zero, then the value of the upper limit 312 equals +¼ inch and the value of the lower limit 314 equals −¼ inch. The averaging window 310 therefore has a value of ½ inch between the upper and lower limits 312 and 314.

The processing head position signal 206 associated with each successive upstream paperboard blank 102 is stored by the controller 202 and a floating average position 316 of the accumulated signals 206 is calculated by the controller 202. The controller 202 shifts the correction window 300 within the averaging window 310 in response to the average position 316. FIG. 6 illustrates the situation where the registration correction window 300 is centered within the averaging window 310. This state occurs during start up of the machine 10 or if the average angular position 316 associated with a plurality of successive upstream paperboard blanks 102 equals the theoretical registration position 306.

FIG. 7 illustrates a situation where a recurring advancing registration error occurs in that successive upstream paperboard blanks 102 are consistently advancing ahead of their initial theoretical or proper registration position 306. In response, the controller 202 shifts the registration correction window 300 upwardly in a positive direction within the averaging window 310 so it is centered about the average position 316.

FIG. 8 illustrates the condition where a recurring lagging registration error occurs, the most common condition in a typical processing machine 10. In response, the controller 202 shifts the center of the registration correction window 300 downwardly in a negative direction to the average position 316. The upper and lower limits 302 and 304 of the registration correction window 300 are likewise shifted so they are centered about the average position 316.

It may be appreciated that by shifting the registration correction window 300, the controller 202 will fully correct registration errors for marks 108 within the registration correction window 300 as centered about the average position 316, i.e. where most marks 108 have been traditionally observed. As such, this registration correction window 300 within an averaging window 310 approach permits the controller 202 to fully correct registration errors for a maximum number of successive blanks 102, since the registration correction window 300 centers itself around where most of the marks 108 are observed.

Turning now to FIGS. 9–13, the operation of the controller 202 of the present invention will be described in greater detail. The controller 202 enters its operating program at reference numeral 400, a point corresponding to activation of the machine 10. The program then initializes a series of variables at block 402. These variables include UPLIMIT, which is a preset value defining the upper maximum correction value, or upper limit 302 of the registration correction window 300, based upon the operating conditions and geometry of the machine. The variable LOWLIMIT is similarly preset to a value corresponding to the lower maximum correction value, or lower limit 304 of the registration correction window 300, again based upon the operating conditions and geometry of the machine 10. The variable EDGEPOS is defined as the angular position of the die drum 36 when the leading edge 104 of the upstream paperboard blank 102 is located at the paperboard blank registration sensor 50. The remaining variables as used within the computer program are initially set to zero.

The program next proceeds to block 404 where the machine operator inputs the variable MARK DISTANCE. MARK DISTANCE is the measured distance in inches from the leading edge 104 of the upstream paperboard blank 102 to the registration mark 108. In other words, MARK DISTANCE defines the initial theoretical or proper registration position 306, i.e. where the paperboard blank registration sensor 50 initially expects to see the registration mark 108. At block 406, MARK DISTANCE is converted to the angular position of the die drum 36 and assigned to the variable REG SET POINT. More particularly, the variable REG SET POINT is calculated by the following equation: (MARK DISTANCE/πd)360+EDGEPOS.

At block 408, the program sets the variable AVGPOS to be equal to the variable REG SET POINT. The variable AVGPOS is defined as the average position 316 of the die drum 36 associated with a plurality of successive paperboard blanks 102 as described above. The program next instructs the controller 202 to establish an averaging window 310 at block 410. The averaging window 300 is centered about the fixed initial valve for the variable REG SET POINT and includes upper and lower limits based upon the geometry and operating conditions of the processing machine.

Figure 10:
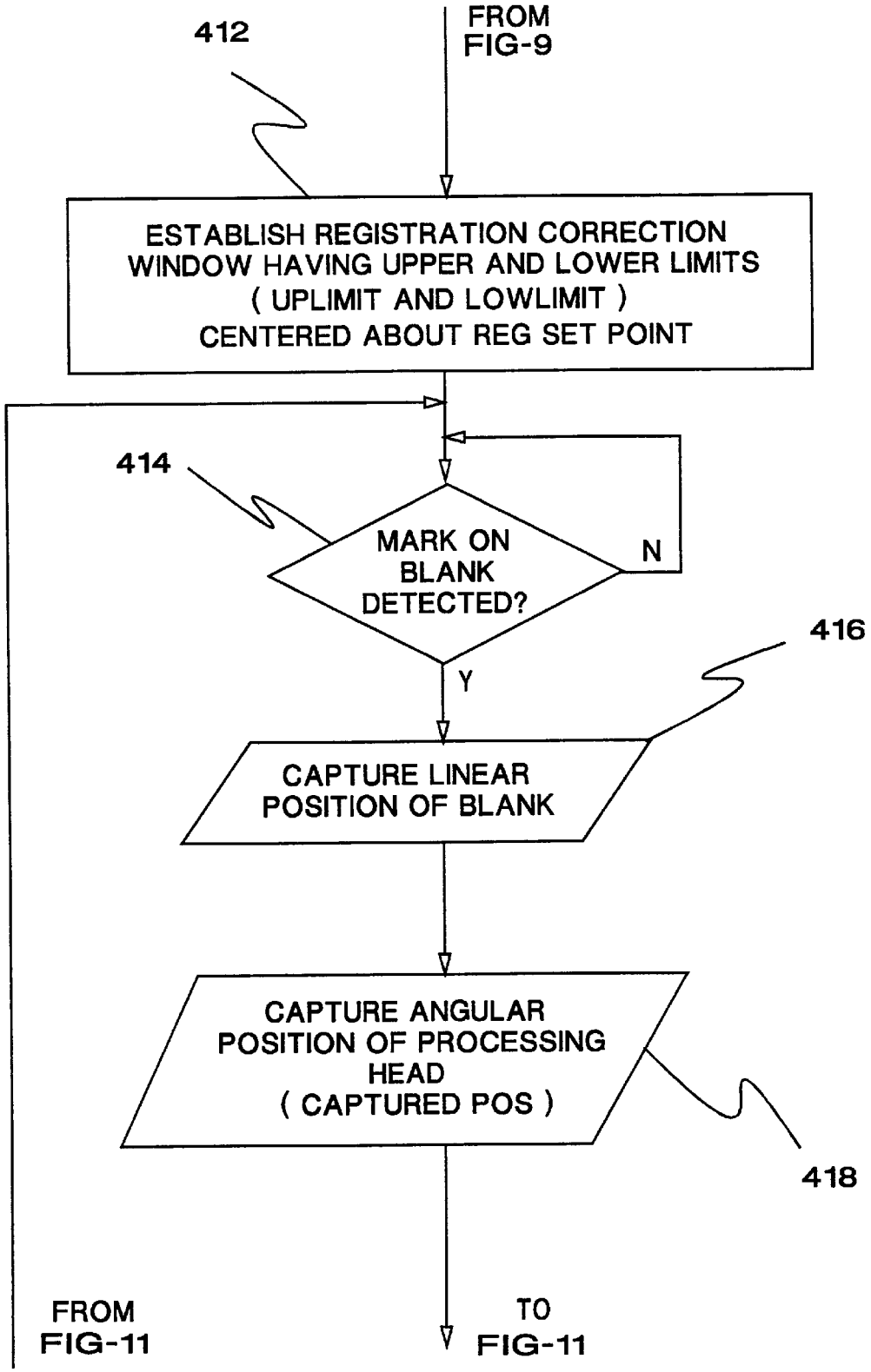

Continuing now with FIG. 10, the controller 202 is instructed at block 412 to establish a registration correction window 300 having upper and lower limits 302 and 304 defined by the variables UPLIMIT and LOWLIMIT, respectively. The registration correction window 300 is initially centered about the initial fixed value of the variable REG SET POINT which equals the theoretical or proper registration position 306, as illustrated in FIG. 5. At block 414, the program enters a loop where it awaits input from the paperboard blank registration sensor 50. If the paperboard blank registration sensor 50 detects the preprinted mark 108 on the upstream paperboard blank 102, then the program continues to block 416 where the sensor 50 transmits the blank position signal 204 to the controller 202 for capturing the linear position of the upstream paperboard blank 102.

Upon receiving the blank position signal 204 of the paperboard blank registration sensor 50, the controller 202 is instructed to capture the angular position of the die drum 36 and store this position as the variable CAPTURED POS at block 418. The angular position of the die drum 36 is transmitted to the controller 202 from the servo motor 44 as processing head position signal 206 (FIG. 5).

Figure 11:
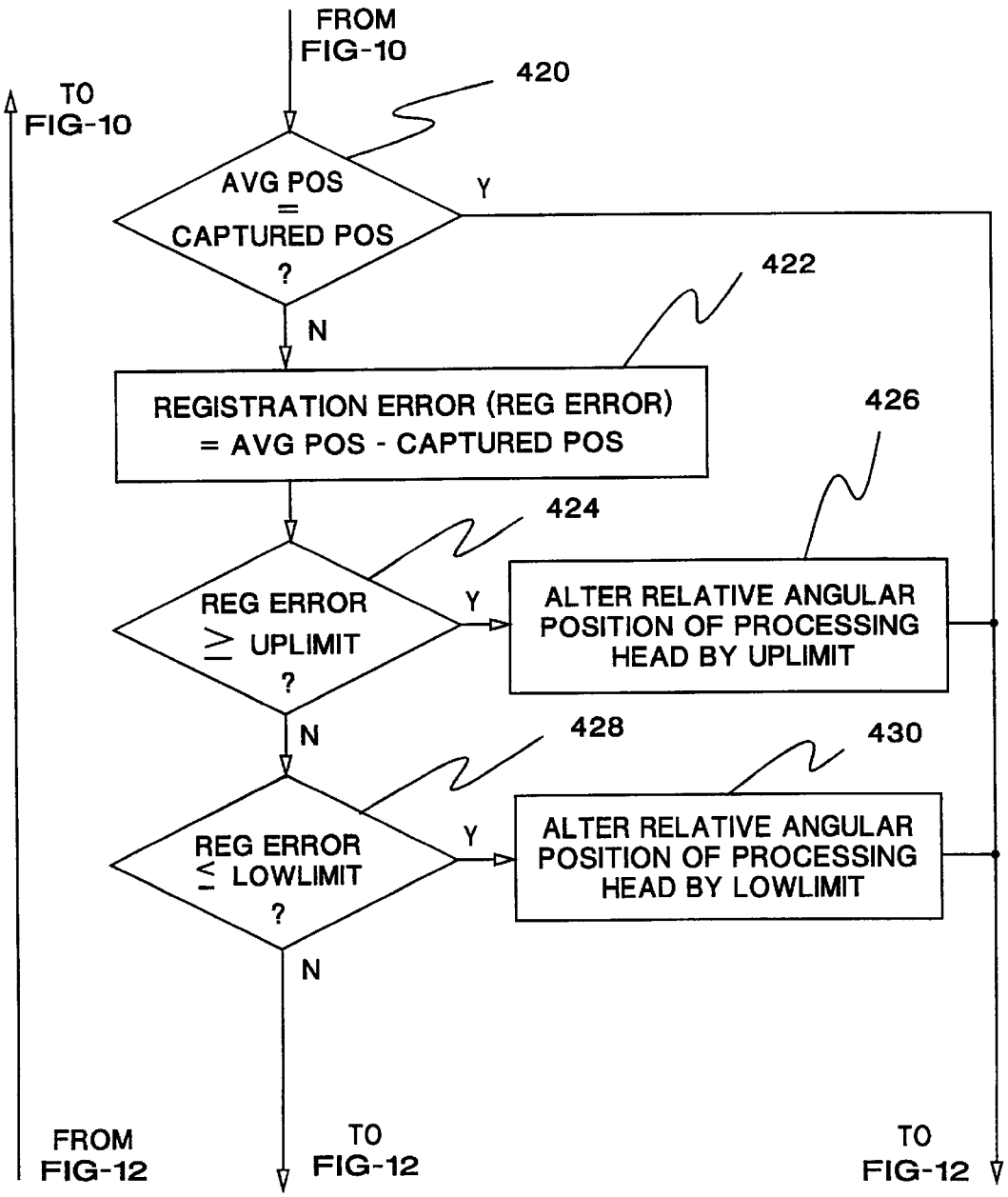

Continuing now with FIG. 11, the program at block 420 determines if the variable AVG POS equals the variable CAPTURED POS. If these two variables are equal then the upstream paperboard blank 102 is in proper registration with the die drum 36 and the program continues at block 434. However, if the AVG POS is not equal to the CAPTURED POS then the program continues to block 422 where the variable REG ERROR is defined as AVG POS minus CAPTURED POS. The REG ERROR variable is defined as the registration error signal between the angular position of the die drum 36 and the linear position of the paperboard blank 102. At block 424 the program determines if REG ERROR is greater than or equal to UPLIMIT. If REG ERROR is greater than or equal to UPLIMIT then the controller 202 sends the registration correction signal 208 to the servo motor 44 to accelerate the die drum 36 and thereby alter the relative angular position of the die drum 36 by the UPLIMIT value or the upper maximum correction value 302. The program then continues at block 434. If REG ERROR is not greater than or equal to UPLIMIT then the program continues to block 428.

Figure 12:
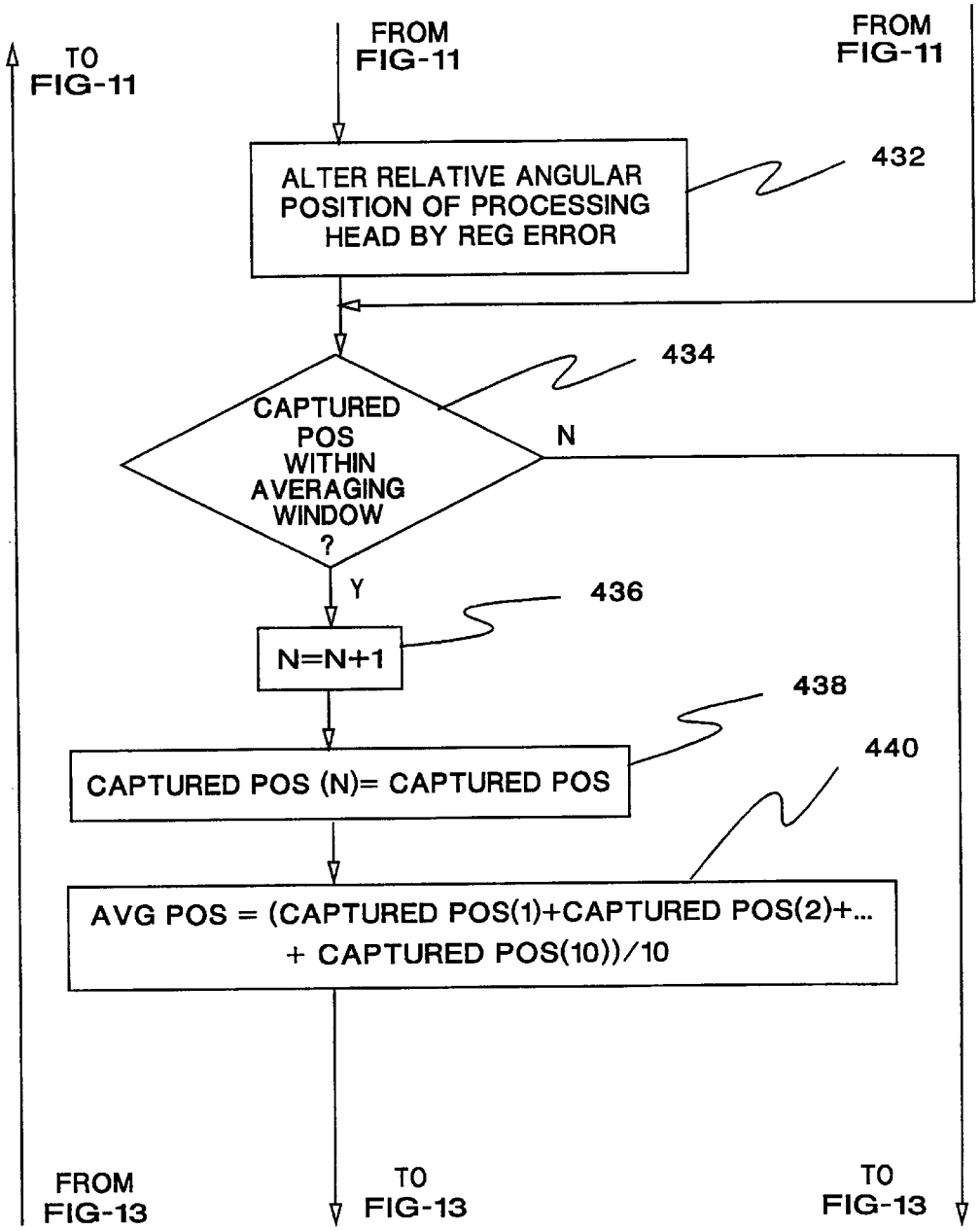
Figure 13:
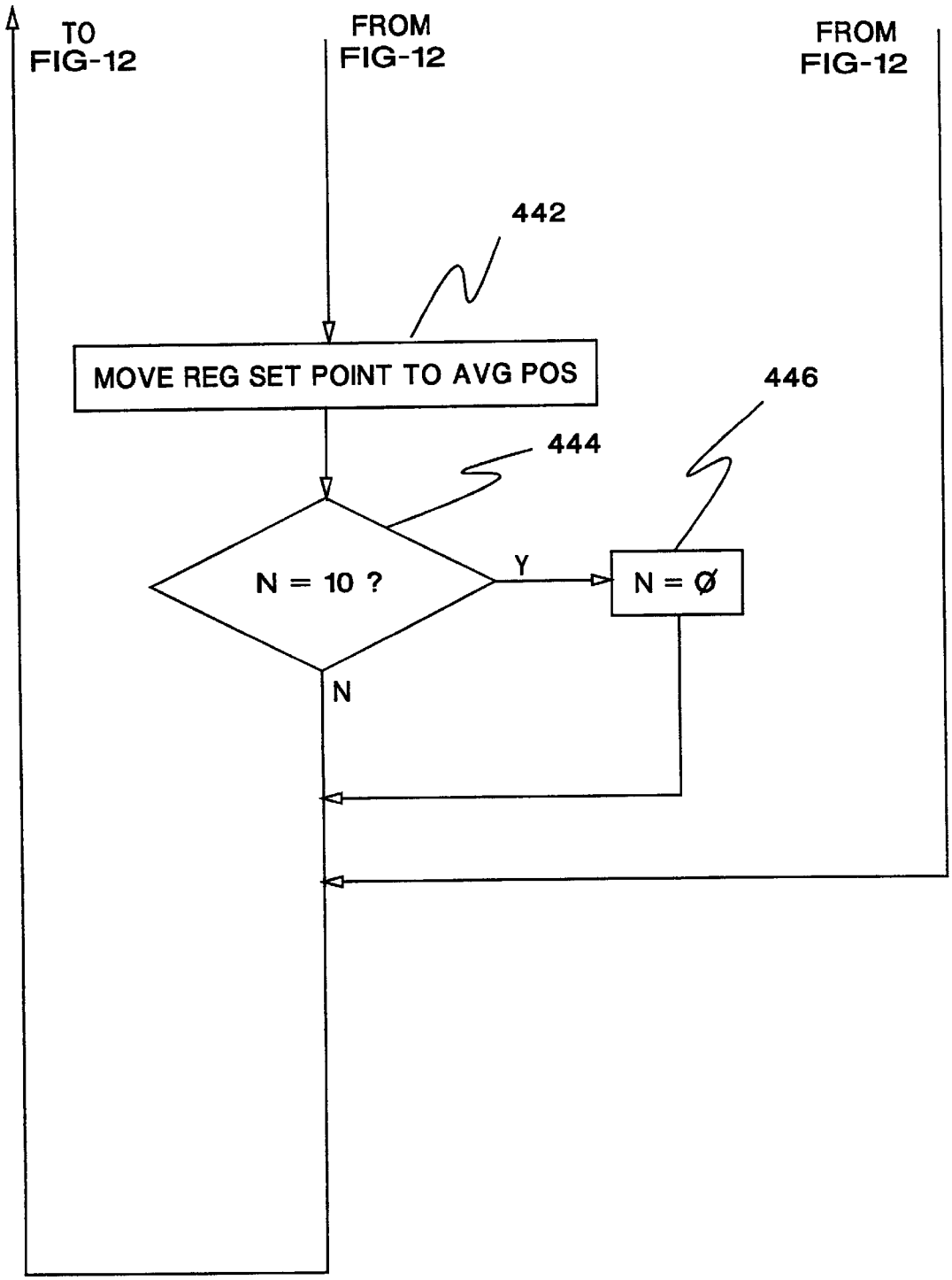

At block 428 the program determines if REG ERROR is less than or equal to LOWLIMIT. In other words, the program determines if REG ERROR is negative and has an absolute value equal to or exceeding the absolute value of LOWLIMIT. If so, the program instructs the controller 202 to send the registration correction signal 208 to the servo motor 44 to decelerate the line speed of the die drum 36 to thereby alter the relative angular position of the die drum 36 by LOWLIMIT or the lower maximum correction value 304. The program then continues at block 434. If the REG ERROR is not less than or equal to the LOW LIMIT then the program continues to block 432 as illustrated in FIG. 12.

At block 432, the program directs the controller to alter the relative angular position of the die drum 36 by the variable REG ERROR. This is accomplished by the controller 202 transmitting the correction signal 208 to the servo motor 44 directing it to either accelerate or decelerate the line speed of the die drum 36 to bring the angular position of the die drum 36 into proper registration with the linear position of the upstream paperboard blank 102. At block 434, the program begins a sub-routine which results in the shifting of the registration correction window 300 within the averaging window 310 as described above.

The program at block 434 initially determines whether the variable CAPTURED POS is within the limits 312 and 314 of the averaging window 310. If the variable CAPTURED POS is not within the averaging window 310 the program returns to block 414 and the value of CAPTURED POS is not averaged. This prevents the processing head position signals 206 associated with paperboard blanks 102 having abnormal or extraordinary registration errors from being averaged with other processing head position signals 206 and thereby skewing the value of the average position 316. If the CAPTURED POS is within the averaging window 310 then the program increments a variable N by the value of one at block 436. The program proceeds to block 438 where CAPTURED POS (N) is set equal to the value for CAPTURED POS. In this manner, each CAPTURED POS value for successive upstream paperboard blanks 102 is assigned a different variable name.

At block 440 the variable AVG POS is set equal to the average of CAPTURED POS (1) through CAPTURED POS (10). Continuing with FIG. 13, the program next directs the controller 202 to move the registration correction window 300 in response to the variable AVG POS. More particularly, the REG SET POINT is moved to the position occupied by AVG POS as illustrated in FIGS. 6 and 7. The UPLIMIT and LOWLIMIT are likewise moved since they are defined as being centered about the REG SET POINT. In other words, the variable REG SET POINT, which is initially set equal to the initial theoretical registration position 306, is redefined to be equal to AVG POS, or the average position 316. At block 444, the program determines if the variable N equals 10. If so, variable N is reset to zero at block 446 and the program continues at block 414. If N does not equal 10 then the variable N retains its value and the program likewise returns to block 414.

It should be apparent from the above description that the present invention provides a paperboard blank processing method and apparatus for sensing and accurately correcting a registration error between a rotary processing head and a paperboard blank. Further, it should be apparent that the method and apparatus of the present invention selectively corrects for registration errors in response to sensing a preprinted mark on a paperboard blank positioned within a predetermined registration correction window. Additionally, the method and apparatus of the present invention adjusts such registration correction window in response to the average of plurality of processing head positions associated with a plurality of successive paperboard blanks.

While the form of apparatus herein described and the method of operation thereof constitute preferred embodiments of the invention, it is to be understood that the invention is not limited to this precise form of apparatus and method, and than changes may be made in either without departing from the scope of the invention which is defined in the appended claims.

What is claimed is:

1. A paperboard blank processing apparatus for working successive paperboard blanks, said paperboard blank processing apparatus comprising:

a rotatably mounted processing head defining a nip for operating upon a downstream paperboard blank;

a drive operably connected to said processing head for driving said processing head in rotation at a predetermined line speed;

a conveyor immediately upstream from said nip for conveying said downstream paperboard blank to said processing head, said conveyor operably connected to said processing head wherein said conveyor operates consistently at substantially said line speed of said processing head;

sensor for detecting an upstream paperboard blank located upstream from said conveyor and providing a signal indicative of said upstream paperboard blank;

wherein a distance between said sensor and said nip is greater than a distance between a trailing edge of the downstream paperboard blank and a leading edge of the upstream paperboard blank; and a controller responsive to said signal for determining whether said processing head is in register with the upstream paperboard blank, said controller further comprising means for varying said line speed of said processing head and said conveyor in unison when said processing head is not in register with the upstream paperboard blank and said downstream paperboard blank is within said nip, thereby bringing said processing head into proper register with the upstream paperboard blank while simultaneously maintaining proper register between said processing head and the downstream paperboard blank.

2. The paperboard blank processing apparatus according to claim 1 wherein said conveyor comprises a plurality of vacuum transfer wheels.

3. The paperboard blank processing apparatus according to claim 1 wherein said processing head and said conveyor are operably connected to a single drive.

4. The paperboard blank processing apparatus according to claim 1 wherein said sensor detects a mark positioned on a surface of said upstream paperboard blank.

5. The paperboard blank processing apparatus according to claim 1 wherein said sensor detects a leading edge of said upstream paperboard blank.

6. The paperboard blank processing apparatus according to claim 1 wherein said processing head comprises a die drum.

7. The paperboard blank processing apparatus according to claim 1 wherein said drive comprises an alternating current servo motor.

8. The paperboard blank processing apparatus according to claim 1 wherein said sensor comprises an optical contrast scanner for sensing transitions in light levels associated with the location of the upstream paperboard blank and producing a signal indicative of the location of the upstream paperboard blank.

9. A paperboard blank processing apparatus for working successive paperboard blanks, said paperboard blank processing apparatus comprising:

a rotatably mounted processing head for operating upon a downstream paperboard blank;

drive operably connected to said processing head for driving said processing head in rotation at a predetermined line speed;

means for monitoring an angular position of said processing head and providing a processing head position signal indicative of said angular position of said processing head;

a paperboard blank sensor for detecting a linear position of an upstream paperboard blank located upstream from said processing head, said paperboard blank sensor providing a blank position signal indicative of the linear position of the upstream paperboard blank; and a controller responsive to said processing head position signal and said blank position signal for generating a registration error signal indicative of registration error between said angular position of said processing head and the linear position of the upstream paperboard blank, said controller further comprising means for determining whether said registration error signal has a value within a predetermined range and means for selectively altering said angular position of said processing head relative to the linear position of the upstream paperboard blank by selectively controlling said drive in response to said registration error signal thereby selectively varying said line speed of said processing head to bring said processing head into register with the linear position of the upstream paperboard blank.

10. The paperboard blank processing apparatus according to claim 9 wherein said controller generates said registration error signal by comparing said processing head position signal to a theoretical registration position signal defining where said processing head is in proper registration with the upstream paperboard blank.

11. The paperboard blank processing apparatus according to claim 9 wherein said controller varies said line speed of said processing head only if said registration error has a value within said predetermined range.

12. The paperboard blank processing apparatus according to claim 9 wherein said predetermined range includes upper and lower limits defining upper and lower maximum correction values for bringing said angular position of said processing head into register with the linear position of the upstream paperboard blank, and said angular position of said processing head is altered by said upper maximum correction value if said registration error signal exceeds said upper limit and said angular position of said processing head is altered by said lower maximum correction value if said registration error signal exceeds said lower limit.

13. The paperboard blank processing apparatus according to claim 9 wherein said controller further comprises means for shifting said predetermined range in response to consistent registration errors between said processing head and a plurality of said upstream paperboard blanks.

14. The paperboard blank processing apparatus according to claim 9 wherein said controller further comprises means for averaging a plurality of said processing head position signals associated with a plurality of successive paperboard blanks to produce an average position signal for said plurality of successive paperboard blanks.

15. The paperboard blank processing apparatus according to claim 14 wherein said controller further comprises means for shifting said predetermined range in response to said average position signal.

16. The paperboard blank processing apparatus according to claim 9 wherein said paperboard blank sensor detects a mark positioned on a surface of said upstream paperboard blank.

17. The paperboard blank processing apparatus according to claim 9 wherein said drive and said means for monitoring said angular position of said processing head comprise an integral alternating current servo motor.

18. A paperboard blank processing apparatus for working successive paperboard blanks, said paperboard processing apparatus comprising:

a rotatably mounted processing head for operating upon a downstream paperboard blank;

a drive operably connected to said processing head for driving said processing head in rotation at a predetermined line speed;

means for monitoring an angular position of said processing head and providing a processing head position signal indicative of said angular position of said processing head;

a paperboard blank sensor for detecting a linear position of an upstream paperboard blank located upstream from said processing head, said paperboard blank sensor providing a blank position signal indicative of the linear position of the upstream paperboard blank;

a controller responsive to said processing head position signal and said blank position signal for generating a registration error signal indicative of registration error between said angular position of said processing head and the linear position of the upstream paperboard blank;

a registration correction window defined by said controller, said registration correction window including upper and lower limits defining upper and lower maximum correction values for bringing said angular position of said processing head into register with the linear position of the upstream paperboard blank, and a theoretical registration position located intermediate said upper and lower limits and defining where said angular position of said processing head and the linear position of the upstream paperboard blank are in proper registration;

wherein said controller generates said registration error signal by comparing said processing head position signal to said theoretical registration position, said controller further comprising means for selectively altering said angular position of said processing head relative to the linear position of the upstream paperboard blank in response to said registration error signal.

19. The paperboard blank processing apparatus according to claim 18 wherein said controller alters said angular position of said processing head relative to the linear position of the paperboard blank by selectively controlling said drive in response to said registration error signal thereby selectively varying said line speed of said processing head to bring said angular position of said processing head into register with the linear position of the upstream paperboard blank.

20. The paperboard blank processing apparatus according to claim 18 wherein said controller alters said angular position of said processing head relative to the linear position of the upstream paperboard blank only if said registration error signal has a value within said registration correction window.

21. The paperboard blank processing apparatus according to claim 18 wherein said controller alters said angular position of said processing head relative to the linear position of the upstream paperboard blank by said upper maximum correction value if said registration error signal exceeds said upper limit and said controller alters said angular position of said processing head relative to the linear position of the upstream paperboard blank by said lower maximum correction value if said registration error signal exceeds said lower limit.

22. The paperboard blank processing apparatus according to claim 18 further comprising an averaging window containing said registration correction window and defined by said controller, wherein said controller selectively shifts said registration correction window within said averaging window.

23. The paperboard blank processing apparatus according to claim 22 wherein said controller further comprises means for averaging a plurality of said processing head position signals associated with a plurality of successive paperboard blanks to produce an average position signal and means for shifting said registration correction window within said averaging window in response to said average position signal.

24. The paperboard blank processing apparatus according to claim 18 wherein said paperboard blank sensor detects a preprinted mark positioned on a surface of said upstream paperboard blank.

25. The paperboard blank processing apparatus according to claim 18 wherein said drive and said means for monitoring said angular position of said processing head comprise an integral alternating current servo motor.

26. A method for maintaining the registration of successive paperboard blanks with a processing head, said method comprising the steps of:

driving a processing head in rotation at a predetermined line speed;

transporting a paperboard blank towards said processing head;

detecting said paperboard blank at a location upstream from said processing head and providing a blank position signal indicative of the position of said paperboard blank;

monitoring an angular position of said processing head and providing a processing head position signal indicative of the angular position of said processing head;

providing a registration correction window including upper and lower limits defining upper and lower maximum correction values for bringing said angular position of said processing head into register with said linear position of said paperboard blank, and a theoretical registration position located intermediate said upper and lower limits and defining where said angular position of said processing head and said linear position of said paperboard blank are in proper registration;

generating a registration error signal by comparing said processing head position signal to said theoretical registration position; and selectively altering said angular position of said processing head relative to the linear position of said paperboard blank in response to said registration error signal.

27. The method according to claim 26 wherein the step of altering said angular position of said processing head comprises selectively varying said line speed of said processing head to bring said angular position of said processing head into register with the linear position of said paperboard blank.

28. The method according to claim 26 wherein said angular position of said processing head is altered relative to said linear position of said paperboard blank only if said registration error signal has a value within said registration correction window.

29. The method according to claim 26 wherein said angular position of said processing head is altered relative to said linear position of said paperboard blank by said upper maximum correction value if said registration error signal exceeds said upper limit and said angular position of said processing head is altered relative to said linear position of said paperboard blank by said lower maximum correction value if said registration error signal exceeds said lower limit.

30. The method according to claim 26 further comprising the steps of:

providing an averaging window;

averaging a plurality of said processing head position signals associated with a plurality of successive paperboard blanks to produce an average position signal; and shifting said registration correction window within said averaging window in response to said average position signal.

* * * * *